US012735839B2

(12) United States Patent
Lee

(10) Patent No.: US 12,735,839 B2
(45) Date of Patent: Sep. 15, 2026

(54) TEXTILE DYEING DEVICE

(71) Applicant: FUZHOU UNIVERSITY OF INTERNATIONAL STUDIES AND TRADE, Fuzhou (CN)

(72) Inventor: Chouyuan Lee, Fuzhou (CN)

(73) Assignee: FUZHOU UNIVERSITY OF INTERNATIONAL STUDIES AND TRADE, Fuzhou (CN)

( * ) Notice: Subject to any disclaimer, the term of this patent is extended or adjusted under 35 U.S.C. 154(b) by 1092 days.

(21) Appl. No.: 17/715,983

(22) Filed: Apr. 8, 2022

(65) Prior Publication Data

US 2022/0325469 A1 Oct. 13, 2022

(30) Foreign Application Priority Data

Apr. 13, 2021 (CN) ..... 202110393498.2

(51) Int. Cl.
*D06P 1/22* (2006.01)
*D06B 3/20* (2006.01)

(52) U.S. Cl.
CPC . *D06P 1/22* (2013.01); *D06B 3/20* (2013.01)

(58) Field of Classification Search
CPC ..... D06B 23/14; D06B 3/20; D06P 1/22
See application file for complete search history.

(56) References Cited

FOREIGN PATENT DOCUMENTS

| | | | | |
|---|---|---|---|---|
| CN | 107099962 A | * | 8/2017 | |
| CN | 108425194 A | * | 8/2018 | |
| CN | 108660635 A | * | 10/2018 | ..... D06B 1/02 |
| CN | 208104787 U | * | 11/2018 | |
| CN | 111286894 A | * | 6/2020 | |
| CN | 212925423 U | * | 4/2021 | |

OTHER PUBLICATIONS

CN107099962—Machine Translation (Year: 2017).*
CN208104787—Machine Translation (Year: 2018).*
CN108660635—Machine Translation (Year: 2018).*
CN108425194—Machine Translation (Year: 2018).*
CN111286894—Machine Translation (Year: 2020).*
CN212925423—Machine Translation (Year: 2021).*

* cited by examiner

*Primary Examiner* — Spencer E. Bell
(74) *Attorney, Agent, or Firm* — HOWARD M COHN and Associates, LLC

(57) ABSTRACT

A textile dyeing device includes a dyeing table and a dyeing vat. The dyeing vat is arranged inside the dyeing table. A motor mounting cavity is defined in the dyeing table. A motor is installed in the motor mounting cavity. The motor is connected with a first gear. The bottom wall of the motor mounting cavity is connected with a second gear. The second gear is engaged with the first gear. A sidewall of the second gear away from the bottom wall of the motor mounting cavity is connected with a first rotating rod. One end of the first rotating rod away from the second gear passes through and seals a bottom wall of the dyeing vat. A rotating block is arranged on the one end of the first rotating rod passing through the dyeing vat. Fan blades are connected with a sidewall of the rotating block.

7 Claims, 4 Drawing Sheets

TEXTILE DYEING DEVICE

TECHNICAL FIELD

The present disclosure relates to a field of textile dyeing technology, and in particular to a textile dyeing device.

BACKGROUND

Dyeing is one of important steps in textile processing. Due to product style, production cost and market needs, textiles are dyed in all aspects of their production. That is, textile dyeing comprises dope dyeing, loose fiber dyeing, tow dyeing, top (cotton sliver) dyeing, yarn dyeing, rope dyeing, fabric dyeing, garment dyeing, Textile dyes are dyes used in textile dyeing. Most of the textile dyes are plant extracts extracting from plant fruits and tree sap. The textile dyes also contain natural chemical extracts such as coal tar. The textile dyes are divided into natural dyes and synthetic dyes, and most of the textile dyes on the market are synthetic dyes. Textile dyes have good coloring ability, are not easy to fade, and are not easy to fade when washed. After textiles are colored, a hand feel does not change much, and the textiles will not become hard. However, a color of the textiles is less bright and saturated than acrylic.

In a textile dyeing process, because the textile dyes are placed in the dye vat for a long time, a dyeing devices in the prior art often lack agitation for the dyes, so that a dyeing effect of the dyes placed for a long time is not good. Moreover, during the textile dyeing process, if clamping of the textiles is not firm enough, dyeing effect of textiles is greatly reduced. Therefore, it is necessary to propose a textile dyeing device for textiles to solve above problems.

SUMMARY

The present disclosure provides a textile dyeing device to solve defects in the prior art that a conventional dyeing device lacks agitation for the dye and a clamping mechanism accidentally loosens textiles, which greatly reduces the dyeing effect of the textiles.

In order to achieve above purposes, the present disclosure provides a textile dyeing device. The textile dyeing device comprises a dyeing table and a dyeing vat. The dyeing vat is arranged inside the dyeing table. A motor mounting cavity is defined in the dyeing table. A motor is installed on a bottom wall of the motor mounting cavity. An output end of the motor is fixedly connected with a first gear. The bottom wall of the motor mounting cavity is rotatably connected with a second gear. The second gear is engaged with the first gear. A sidewall of the second gear away from the bottom wall of the motor mounting cavity is fixedly connected with a first rotating rod. One end of the first rotating rod away from the second gear passes through and seals a bottom wall of the dyeing vat. A rotating block is arranged on the one end of the first rotating rod passing through the dyeing vat. Fan blades are fixedly connected with a sidewall of the rotating block. A sidewall of the first rotating rod is fixedly connected with a first rotating wheel. The bottom wall of the motor mounting cavity is rotatably connected with a second rotating rod. A sidewall of the second rotating rod is fixedly connected with a second rotating wheel. The first rotating wheel is connected with the second rotating wheel through a belt. One end of the second rotating rod away from the bottom wall of the motor mounting cavity passes through a top wall of the motor mounting cavity and is fixedly connected with a driven mechanism.

Optionally, the driven mechanism comprises a first screw, a first nut, and a horizontal plate. The one end of the second rotating rod passing through the top wall of the motor mounting cavity is fixedly connected with the first screw. An outer top wall of the dyeing table is fixedly connected with a vertical limit rod. An outer wall of the first screw is threadedly connected with the first nut. A sidewall of the first nut is slidably connected with a sidewall of the vertical limit rod. The horizontal plate is fixedly connected with a sidewall of the first nut away from the vertical limit rod. A vertical rod is fixedly connected with the outer top wall of the dyeing table. A movable groove is provided on a sidewall of the vertical rod close to the vertical limit rod. An outer sidewall of the horizontal plate away from the first nut is slidably connected with an inner wall of the movable groove.

Optionally, one end of the first screw away from the second rotating rod is fixedly connected with a baffle plate. An outer diameter of the baffle plate is greater than an outer diameter of the first screw.

Optionally, the sidewall of the vertical rod comprises a bearing mounting cavity. A bearing is arranged on an inner wall of the bearing mounting cavity. An inner wall of the bearing is fixedly connected with a horizontal rotating rod. A first end of the horizontal rotating rod passes through the sidewall of the vertical rod and is fixedly connected with a handle. A second end of the horizontal rotating rod away from the handle is fixedly connected with a cross rod.

Optionally, a plurality of slots are provided on an inner wall of the rotating block. A torsion spring is fixedly connected with one end of the first rotating rod away from the second gear. A sidewall of the torsion spring is fixedly connected with a tooth. The tooth abuts against a sidewall of one of the plurality of slots.

Optionally, a rotating shaft mounting cavity is defined in the horizontal plate. An outlet is defined in a sidewall of the rotating shaft mounting cavity. A fixed block is fixedly connected with the sidewall of the rotating shaft mounting cavity. A rotating shaft is arranged inside the rotating shaft mounting cavity. The rotating shaft passes through the fixed block. A spring is fixedly connected with a sidewall of the fixed block close to the outlet. One end of the spring away from the fixed block is fixedly connected with a circular plate. The rotating shaft passes through the circular plate. A positioning rod is fixedly connected with a sidewall of the rotating shaft. A sidewall of the positioning rod abuts against a sidewall of the circular plate.

Optionally, two third gears are fixedly connected with the sidewall of the rotating shaft away from the positioning rod. Two bidirectional screws are rotatably connected to sidewalls of the rotating shaft mounting cavity. One end of each of the two bidirectional screws away from a corresponding sidewall of the rotating shaft mounting cavity is connected with a fourth gear. Each fourth gear is engaged with a corresponding third gear. Two second nuts are symmetrically threaded on a sidewall of each of the two bidirectional screws. The four second nuts are slidably connected with the sidewalls of the rotating shaft mounting cavity. One side of each of the four second nuts away from a corresponding sidewall of the rotating shaft mounting cavity are fixedly connected with a connecting rod. Two clamping sliding grooves are provided on the inner sidewall of the horizontal plate. The connecting rods pass through an inner wall of the two clamping sliding grooves and are fixedly connected with clamping plates.

Optionally, a groove is provided on one end of the rotating shaft close to the outlet. A shape of the groove is the same as a shape of the cross rod.

Compared with the prior art, the motor of the present disclosure runs to drive the fan blades to rotate, so that the fan blades stir dyes at a bottom portion of the dyeing vat and the dyes at the bottom portion of the dyeing vat would not be precipitated due to long standing time, thereby the dyeing effect of textiles is not affected.

When the motor of the present disclosure is reversely rotated, the first screw drives the horizontal plate to move upward, and drives the fan blades to rotate in the dye vat. At this time, the horizontal plate drives clamped textiles away from the dye vat. When the clamped textiles moves downward, the rotating block is not driven by the motor and therefore does not affect a normal dyeing of the clamped textiles.

In the present disclosure, only when the first nut drives the horizontal plate to move to a predetermined position, clamping of the clamping plates on the clamped textiles is adjusted by rotating the handle, thereby the textiles are loosened by the clamping plates, so the textiles are easily removed after dyeing.

1—dyeing table; 2—dyeing vat; 3—motor; 4—first gear; 5—second gear; 6—first rotating rod; 7—rotating block; 8—fan blade; 9—first rotating wheel; 10—second rotating rod; 11—second rotating wheel; 12—first screw; 13—first nut; 14—horizontal plate; 15—vertical limit rod; 16—vertical rod; 17—movable groove; 18—baffle plate; 19—bearing; 20—horizontal rotating rod' 21—handle; 22—cross rod; 23—slot; 24—torsion spring; 25—tooth; 26—outlet; 27—fixed block; 28—rotating shaft; 29—spring; 30—circular plate; 31—positioning rod; 32—third gear; 33—bidirectional screw; 34—fourth gear; 35—second nut; 36—connecting rod; 37—clamping sliding groove; 38—clamping plate; 39—groove.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments.

Figure 1:
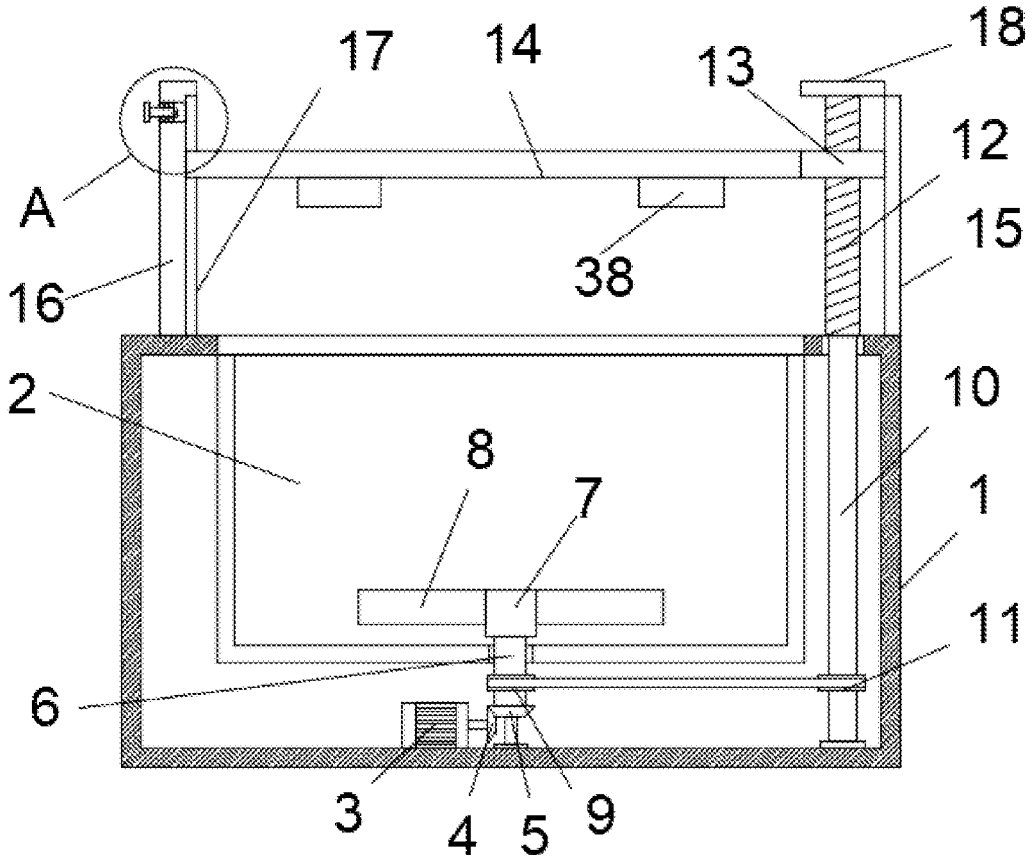
FIG. 1 is a schematic diagram showing a structure of a textile dyeing device of the present disclosure.
Figure 2:
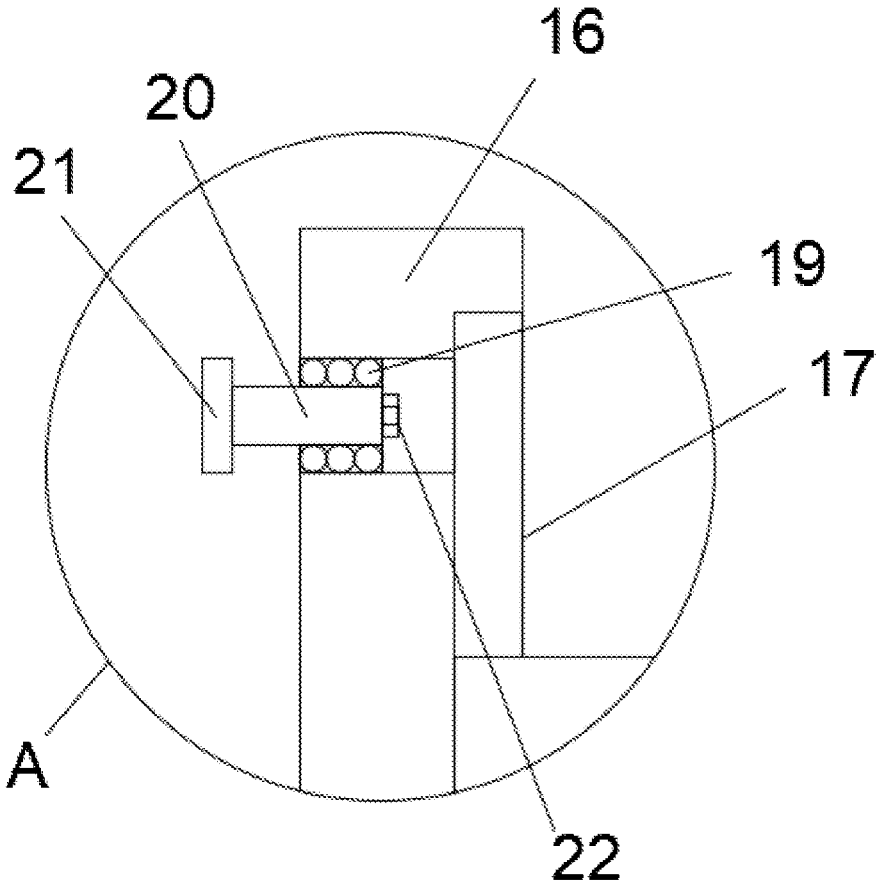
FIG. 2 is an enlarged schematic diagram of portion A shown in FIG. 1.
Figure 3:
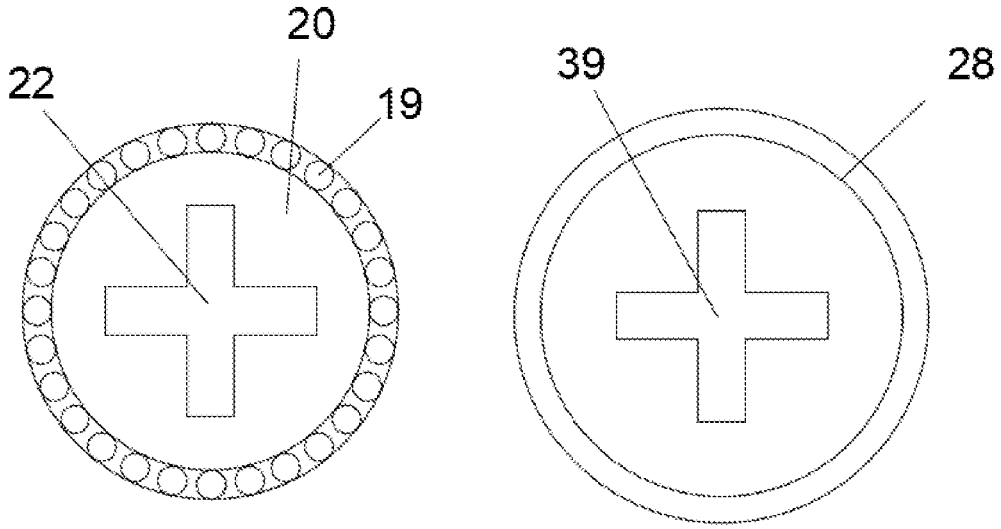
FIG. 3 is a top elevational view of a groove and a cross rod of the present disclosure.
Figure 4:
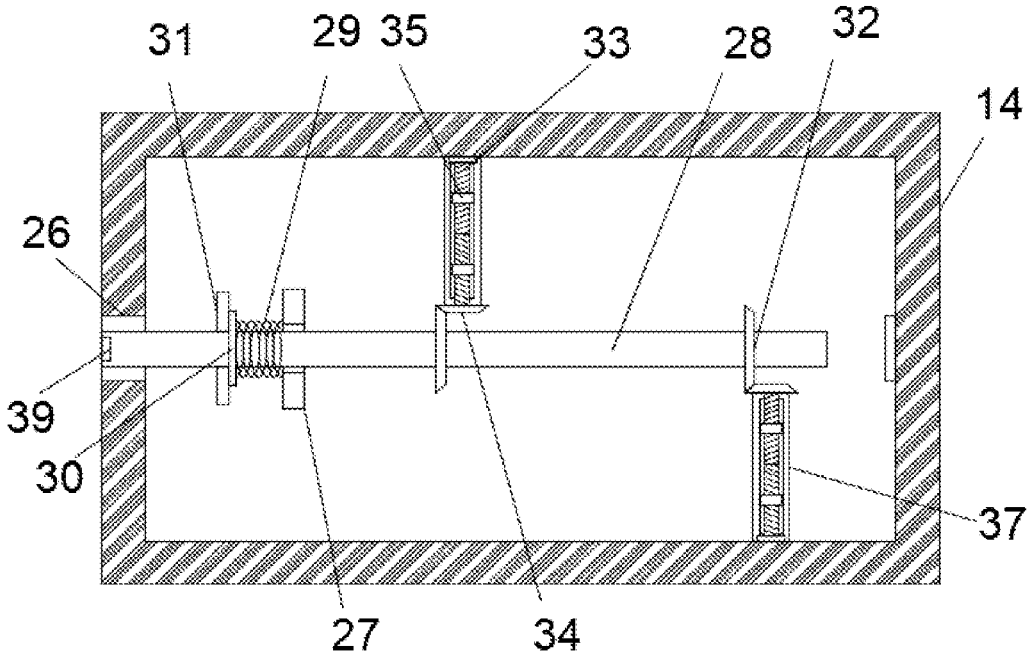
FIG. 4 is a top elevational view of a horizontal plate of the present disclosure.
Figure 5:
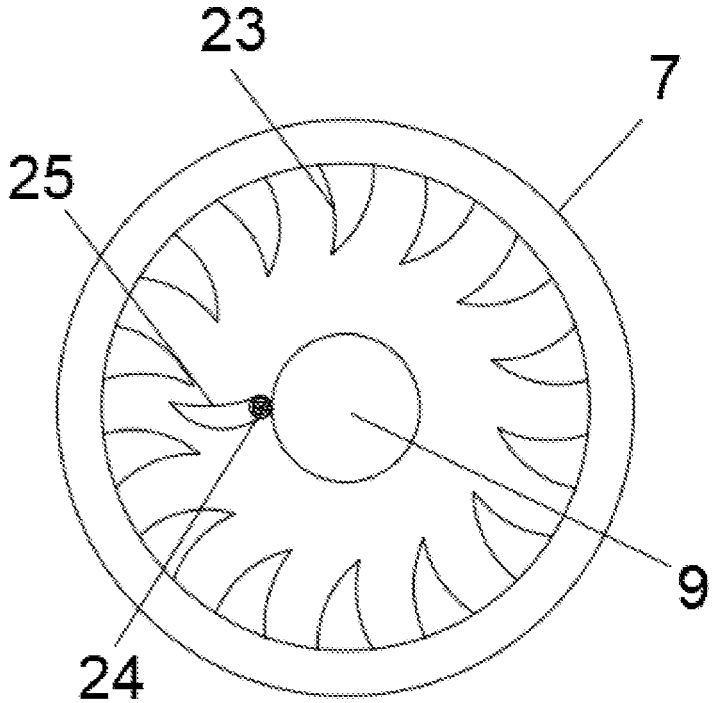
FIG. 5 is a schematic diagram showing connection between a rotating block and first rotating rods of the present disclosure.
Figure 6:
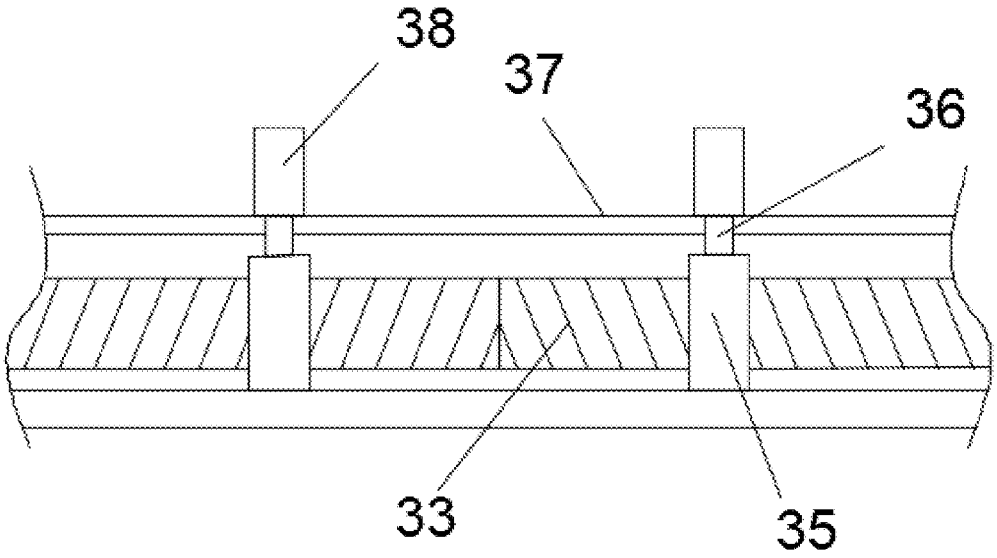
FIG. 6 is a schematic diagram showing connection between a bidirectional screw and second nuts of the present disclosure.

As shown in FIGS. 1-6, the present disclosure provides a textile dyeing device for textile. The textile dyeing device comprises a dyeing table 1 and a dyeing vat 2. The dyeing vat 2 is arranged inside the dyeing table 1. A motor mounting cavity is defined in the dyeing table 1. A motor 3 is installed on a bottom wall of the motor mounting cavity. An output end of the motor 3 is fixedly connected with a first gear 4. The bottom wall of the motor mounting cavity is rotatably connected with a second gear 5. The second gear 5 is engaged with the first gear 4. A sidewall of the second gear 5 away from the bottom wall of the motor mounting cavity is fixedly connected with a first rotating rod 6. One end of the first rotating rod 6 away from the second gear 5 passes through and seals a bottom wall of the dyeing vat 2. A rotating block 7 is arranged on the one end of the first rotating rod 6 passing through the dyeing vat 2. A plurality of slots 23 are provided on an inner wall of the rotating block 7. A torsion spring 24 is fixedly connected with one end of the first rotating rod 6 away from the second gear 5. A sidewall of the torsion spring 24 is fixedly connected with a tooth 25. The tooth 25 abuts against a sidewall of one of the plurality of slots 23.

Fan blades 8 are fixedly connected with a sidewall of the rotating block 7. A sidewall of the first rotating rod 6 is fixedly connected with a first rotating wheel 9. The bottom wall of the motor mounting cavity is rotatably connected with a second rotating rod 10. A sidewall of the second rotating rod 10 is fixedly connected with a second rotating wheel 11. The first rotating wheel 9 is connected with the second rotating wheel 11 through a belt. One end of the second rotating rod 10 away from the bottom wall of the motor mounting cavity passes through a top wall of the motor mounting cavity and is fixedly connected with a driven mechanism. The driven mechanism comprises a first screw 12, a first nut 13, and a horizontal plate 14. The one end of the second rotating rod 10 passing through the top wall of the motor mounting cavity is fixedly connected with the first screw 12. One end of the first screw 12 away from the second rotating rod 10 is fixedly connected with a baffle plate 18. An outer diameter of the baffle plate 18 is greater than an outer diameter of the first screw 12.

An outer top wall of the dyeing table 1 is fixedly connected with a vertical limit rod 15. An outer wall of the first screw 12 is threadedly connected with the first nut 13. A sidewall of the first nut 13 is slidably connected with a sidewall of the vertical limit rod 15. The horizontal plate 14 is fixedly connected with a sidewall of the first nut 13 away from the vertical limit rod 15. A vertical rod 16 is fixedly connected with the outer top wall of the dyeing table 1. The sidewall of the vertical rod 16 comprises a bearing mounting cavity. A bearing 19 is arranged on an inner wall of the bearing mounting cavity. An inner wall of the bearing 19 is fixedly connected with a horizontal rotating rod 20. A first end of the horizontal rotating rod 20 passes through the sidewall of the vertical rod 16 and is fixedly connected with a handle 21. A second end of the horizontal rotating rod 20 away from the handle 21 is fixedly connected with a cross rod 22. A movable groove 17 is provided on a sidewall of the vertical rod 16 close to the vertical limit rod 15. An outer sidewall of the horizontal plate 14 away from the first nut 13 is slidably connected with an inner wall of the movable groove 17.

A rotating shaft mounting cavity is defined in the horizontal plate 14. An outlet 26 is defined in a sidewall of the rotating shaft mounting cavity. A fixed block 27 is fixedly connected with the sidewall of the rotating shaft mounting cavity. A rotating shaft 28 is arranged inside the rotating shaft mounting cavity. A groove 39 is provided on one end of the rotating shaft 28 close to the outlet 26. A shape of the groove 39 is the same as a shape of the cross rod 22. The rotating shaft 28 passes through the fixed block 27. A spring 29 is fixedly connected with a sidewall of the fixed block 28 close to the outlet 26. One end of the spring 29 away from the fixed block 27 is fixedly connected with a circular plate 30. The rotating shaft 28 passes through the circular plate 30. A positioning rod 31 is fixedly connected with a sidewall of the rotating shaft 28. A sidewall of the positioning rod 31 abuts against a sidewall of the circular plate 30. Two third gears 32 are fixedly connected with the sidewall of the rotating shaft 28 away from the positioning rod 31.

Two bidirectional screws 33 are rotatably connected to sidewalls of the rotating shaft mounting cavity. One end of each of the two bidirectional screws 33 away from a corresponding sidewall of the rotating shaft mounting cavity is connected with a fourth gear 34. Each fourth gear 34 is engaged with a corresponding third gear 32. Two second nuts 35 are symmetrically threaded on a sidewall of each of the two bidirectional screws 33. The four second nuts 35 are slidably connected with the sidewalls of the rotating shaft mounting cavity. One side of each of the four second nuts 35 away from a corresponding sidewall of the rotating shaft mounting cavity are fixedly connected with a connecting rod 36. Two clamping sliding grooves 37 are provided on an inner sidewall of the horizontal plate 14. The connecting rods 36 pass through an inner wall of the two clamping sliding grooves 37 and are fixedly connected with clamping plates 38, so the textiles are firmly clamped, which improves a dyeing effect.

In the present invention, rotation of the motor 3 makes the first gear 4 drive the second gear 5 to rotate, and the first rotating rod 6 fixedly connected with the second gear 5 drives the torsion spring 24 and the tooth 25 to move, so the slots 23 rotate with the rotating block 7 and the fan blades 8 stir the dyes in a bottom portion of the dye vat 2.

At this time, the first rotating wheel 9 fixedly connected with the sidewall of the first rotating rod 6 drives the second rotating wheel 11 to rotate, and the second rotating wheel 11 drives the second rotating rod 10 to rotate. The first screw 12 fixed connected with the second rotating rod 10 rotates accordingly, and the first nut 13 slides along a direction of the vertical limit rod 15, so that the horizontal plate 14 drives clamping mechanisms to move upward. When the motor 3 is reversely rotates, the tooth 25 does not drive the rotating block 7 to rotate under action of the torsion spring 24, and the fan blades 8 do not rotate. At this time, the horizontal plate 14 drives the clamping mechanism to move downward and the clamped textiles are dyed.

When the first nut 13 drives the horizontal plate 14 to move up to a predetermined position, the rotating shaft 28 under action of the spring 29 makes the groove 39 abut against the cross rod 22, and the handle 21 is rotated to make the horizontal rotating rod 20 rotate, so that the rotating shaft 28 rotates accordingly. The third gears 32 fixedly connected with the sidewall of the rotating shaft 28 drive the fourth gears 34 to rotate, thereby making the bidirectional screws 33 to rotate, and the second nuts 35 threadedly connected with the bidirectional screws 33 drive the connecting rods 36 and the clamping plates 38 to move, so as to firmly clamp the textiles. Thus, the dyeing effect of the textiles is good.

It should be understood in the description of the present disclosure that terms such as "coaxial", "bottom", "one end", "top", "middle", "other end", "upper", "side", "top", "inside", "front", "center", "two ends" etc. indicate direction or position relationships shown based on the drawings, and are only intended to facilitate the description of the present disclosure and the simplification of the description rather than to indicate or imply that the indicated device or element must have a specific direction or be constructed and operated in a specific direction, and therefore, shall not be understood as a limitation to the present disclosure.

Foregoing descriptions are only optional embodiments of the present disclosure and are not intended to limit the present disclosure. Any modification, equivalent replacement, or improvement within the disclosed technical scope of the present disclosure made according to technical solutions and inventive concepts of the present disclosure by those skilled in the art should be included in the protection scope of the present disclosure.

Although the optional embodiments of the present disclosure have been described above in conjunction with the accompanying drawings, the present disclosure is not limited to the above-mentioned specific embodiments, which are only illustrative rather than restrictive. Those of ordinary skill in the art, under the inspiration of the present disclosure, without departing from the spirit of the present disclosure and the protection scope of the claims, are able to make many other embodiments, which should all belong to the protection scope of the present disclosure.

What is claimed is:

1. A textile dyeing device, comprising: a dyeing table and a dyeing vat;

wherein the dyeing vat is arranged inside the dyeing table;

wherein a motor mounting cavity is defined in the dyeing table, a motor is installed on a bottom wall of the motor mounting cavity, and an output end of the motor is fixedly connected with a first gear;

wherein the bottom wall of the motor mounting cavity is rotatably connected with a second gear, the second gear is engaged with the first gear, and a sidewall of the second gear away from the bottom wall of the motor mounting cavity is fixedly connected with a first rotating rod;

wherein one end of the first rotating rod away from the second gear passes through and seals a bottom wall of the dyeing vat, a rotating block is arranged on the one end of the first rotating rod passing through the dyeing vat, fan blades are fixedly connected with a sidewall of the rotating block, and a sidewall of the first rotating rod is fixedly connected with a first rotating wheel;

wherein the bottom wall of the motor mounting cavity is rotatably connected with a second rotating rod, a sidewall of the second rotating rod is fixedly connected with a second rotating wheel, and the second rotating wheel is connected with the first rotating wheel through a belt;

wherein one end of the second rotating rod away from the bottom wall of the motor mounting cavity passes through a top wall of the motor mounting cavity and is fixedly connected with a driven mechanism, and the driven mechanism comprises a first screw, a first nut, and a horizontal plate.

2. The textile dyeing device according to claim 1, wherein the one end of the second rotating rod passing through the top wall of the motor mounting cavity is fixedly connected with the first screw, and an outer wall of the first screw is threadedly connected with the first nut;

wherein an outer top wall of the dyeing table is fixedly connected with a vertical limit rod, and a sidewall of the first nut is slidably connected with a sidewall of the vertical limit rod;

wherein a vertical rod is fixedly connected with the outer top wall of the dyeing table, and a movable groove is provided on a sidewall of the vertical rod facing the vertical limit rod;

wherein the horizontal plate is fixedly connected with a sidewall of the first nut away from the vertical limit rod, and an outer sidewall of the horizontal plate away from the first nut is slidably connected with an inner wall of the movable groove.

3. The textile dyeing device according to claim 2, wherein one end of the first screw away from the second rotating rod is fixedly connected with a baffle plate, and an outer diameter of the baffle plate is greater than an outer diameter of the first screw.

4. The textile dyeing device according to claim 2, wherein the sidewall of the vertical rod comprises a bearing mounting cavity;

wherein a bearing is arranged on an inner wall of the bearing mounting cavity, and an inner wall of the bearing is fixedly connected with a horizontal rotating rod;

wherein a first end of the horizontal rotating rod passes through the sidewall of the vertical rod and is fixedly connected with a handle, and a second end of the horizontal rotating rod away from the handle is fixedly connected with a rod with a cross-shaped end.

5. The textile dyeing device according to claim 1, wherein a plurality of slots are provided on an inner wall of the rotating block;

wherein a torsion spring is fixedly connected with one end of the first rotating rod away from the second gear, a sidewall of the torsion spring is fixedly connected with a tooth, and the tooth abuts against a sidewall of one of the plurality of slots.

6. The textile dyeing device according to claim 2, wherein a rotating shaft mounting cavity is defined in the horizontal plate, wherein an outlet is defined on a left sidewall of the rotating shaft mounting cavity, and a fixed block is fixedly connected with a bottom wall of the rotating shaft mounting cavity;

wherein a rotating shaft is arranged inside the rotating shaft mounting cavity, and the rotating shaft passes through the fixed block;

wherein a spring is fixedly connected with a sidewall of the fixed block facing the outlet, one end of the spring away from the fixed block is fixedly connected with a circular plate, and the rotating shaft passes through the circular plate;

wherein a positioning rod is fixedly connected with a sidewall of the rotating shaft, and a sidewall of the positioning rod abuts against a sidewall of the circular plate.

7. The textile dyeing device according to claim 6, wherein a groove is provided on one end of the rotating shaft disposed in the outlet; a shape of the groove of the rotating shaft is the same as a shape of a cross.

* * * * *